US011849846B1

(12) United States Patent
Hewatt

(10) Patent No.: US 11,849,846 B1
(45) Date of Patent: Dec. 26, 2023

(54) DISPLAY MOUNTING

(71) Applicant: Christopher B. Hewatt, Denver, CO (US)

(72) Inventor: Christopher B. Hewatt, Denver, CO (US)

( * ) Notice: Subject to any disclaimer, the term of this patent is extended or adjusted under 35 U.S.C. 154(b) by 0 days.

(21) Appl. No.: 17/874,341

(22) Filed: Jul. 27, 2022

(51) Int. Cl.
*A47B 97/00* (2006.01)

(52) U.S. Cl.
CPC ..... *A47B 97/001* (2013.01)

(58) Field of Classification Search
None
See application file for complete search history.

(56) References Cited

U.S. PATENT DOCUMENTS

| | | | | |
|---|---|---|---|---|
| 791,060 | A | 5/1905 | Wallace | |
| 5,342,014 | A | 8/1994 | Wilson | |
| 6,095,478 | A | 8/2000 | Barnes | |
| D532,290 | S | 11/2006 | David | |
| D595,277 | S * | 6/2009 | Bremmon | D14/239 |
| 8,958,200 | B2 | 2/2015 | Bremmon et al. | |
| 10,018,299 | B2 * | 7/2018 | Feldman | F16M 11/22 |
| 10,047,902 | B2 | 8/2018 | Lukach | |
| D836,617 | S | 12/2018 | Shu | |
| 11,105,458 | B2 | 8/2021 | Runger et al. | |
| D932,474 | S | 10/2021 | Cohen | |
| 2005/0092890 | A1 * | 5/2005 | Liao | B60R 11/0235 248/917 |
| 2007/0235614 | A1 | 10/2007 | O'Keene et al. | |
| 2010/0309615 | A1 | 12/2010 | Grey et al. | |
| 2012/0255919 | A1 | 10/2012 | Jones et al. | |
| 2016/0058184 | A1 * | 3/2016 | Whalen | A47B 47/00 108/28 |
| 2016/0312948 | A1 * | 10/2016 | Stifal | F16M 13/02 |
| 2017/0350554 | A1 * | 12/2017 | Stifal | F16M 13/02 |
| 2021/0310610 | A1 * | 10/2021 | Fehr | F16B 2/065 |
| 2023/0165368 | A1 * | 6/2023 | Pei | F16M 11/041 248/277.1 |

* cited by examiner

*Primary Examiner* — Steven M Marsh
(74) *Attorney, Agent, or Firm* — MP Patents, LLC

(57) ABSTRACT

A system for mounting a display to a vertical surface includes an angle bar, at least one rail, a carriage and a number of anchors. The angle bar has a first planar portion configured for mounting to the vertical surface and a second planar portion extending from the first planar portion. Configured to hang from the second planar portion of the angle bar and slide therealong, the rail has a length defined between first and second ends. The carriage includes a display mounting panel and is configured for selectively sliding along the rail towards the first or second ends. The anchors are configured for selectively locking the carriage to the rail at any of a variety of positions between the first and second ends.

21 Claims, 4 Drawing Sheets

DISPLAY MOUNTING

TECHNICAL FIELD

The disclosure pertains to mounting objects to support surfaces.

SUMMARY

The disclosure describes a display mount system. The display mount system includes an angle bar, first and second hanging rails, a carriage and a number of anchors. The angle bar has a first leg with a number of fastener holes and a second leg. The first and second hanging rails each have a length and a transverse slot slidably engaging the second leg of the angle bar. The carriage includes a display mounting platform, a first arm extending from the mounting platform in a first direction to a first distal end and a second arm extending from the mounting platform in a second, opposite direction to a second distal end. The anchors removably couple the first and second arms to the first and second hanging rails transverse thereto.

The disclosure also describes a system for mounting a display to a vertical surface. The system for mounting a display to a vertical surface includes an angle bar, at least one rail, a carriage and a number of anchors. The angle bar has a first planar portion configured for mounting to the vertical surface and a second planar portion extending from the first planar portion. Configured to hang from the second planar portion of the angle bar and slide therealong, the rail has a length defined between first and second ends. The carriage includes a display mounting panel and is configured for selectively sliding along the rail towards the first or second ends. The anchors are configured for selectively locking the carriage to the rail at any of a variety of positions between the first and second ends.

Further, the disclosure describes a system for mounting a display. The system includes a track and a mounting panel configured for, relative to the track, translation in first and second perpendicular directions relative to the track without rotation.

BRIEF DESCRIPTION OF THE FIGURES

The summary above, as well as the following detailed description of illustrative embodiments, is better understood when read in conjunction with the appended drawings. For the purpose of illustrating the disclosure, example constructions are shown in the drawings. However, the disclosure is not limited to specific methods and instrumentalities disclosed herein. Moreover, those having ordinary skill in the art will understand that the drawings are not to scale. Wherever possible, like elements have been indicated by identical numbers.

Embodiments of the disclosure will now be described, by way of example only, with reference to the following diagrams wherein.

DETAILED DESCRIPTION

The following detailed description illustrates embodiments of the disclosure and manners by which they can be implemented. Although the preferred mode of carrying out disclosed systems, methods and associated apparatuses has been described, those of ordinary skill in the art would recognize that other embodiments for carrying out or practicing disclosed systems, methods and associated apparatuses are also possible.

It should be noted that the terms "first", "second", and the like, herein do not denote any order, quantity, or importance, but rather are used to distinguish one element from another. Further, the terms "a" and "an" herein do not denote a limitation of quantity, but rather denote the presence of at least one of the referenced item.

Known systems for mounting objects such as displays to support surfaces such as walls require creating holes in the support surfaces for receiving fasteners that fix the objects or systems to which the objects are mounted to the support surfaces. When it is desirable to move such objects to a different support surface or a different position on the support surface, additional holes are required which damages the support surface.

Embodiments of the disclosure provide an angle bar as a base for mounting to a support surface which enables moving the object in two or more directions on the support surface without requiring additional holes. Thus, embodiments of the disclosure substantially eliminate, or at least partially address, problems in the prior art, enabling reduction of the number of holes needed in a support surface to mount an object which thereby reduces the amount of damage done to the support surface.

Additional aspects, advantages, features and objects of the disclosure will be made apparent from the drawings and the detailed description of the illustrative embodiments construed in conjunction with the appended claims that follow.

It will be appreciated that described features are susceptible to being combined in various combinations without departing from the scope of the disclosure as defined by the appended claims.

Disclosed systems for mounting a display include a track and a mounting panel configured for, relative to the track, translation in a first direction and second direction perpendicular to the first direction.

Figure 1:
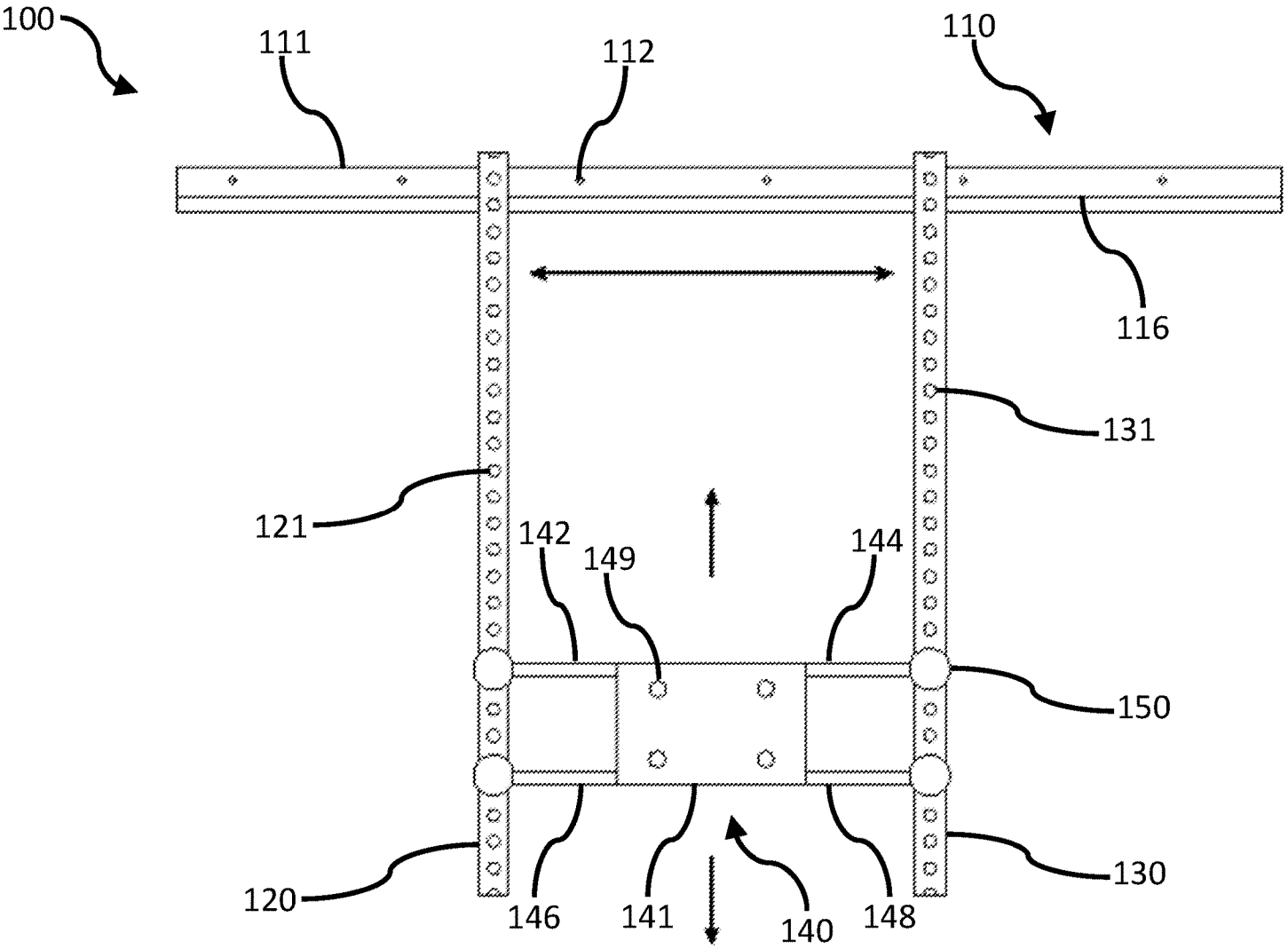
FIG. 1 illustrates a front view of an example display mount system.
Figure 2:
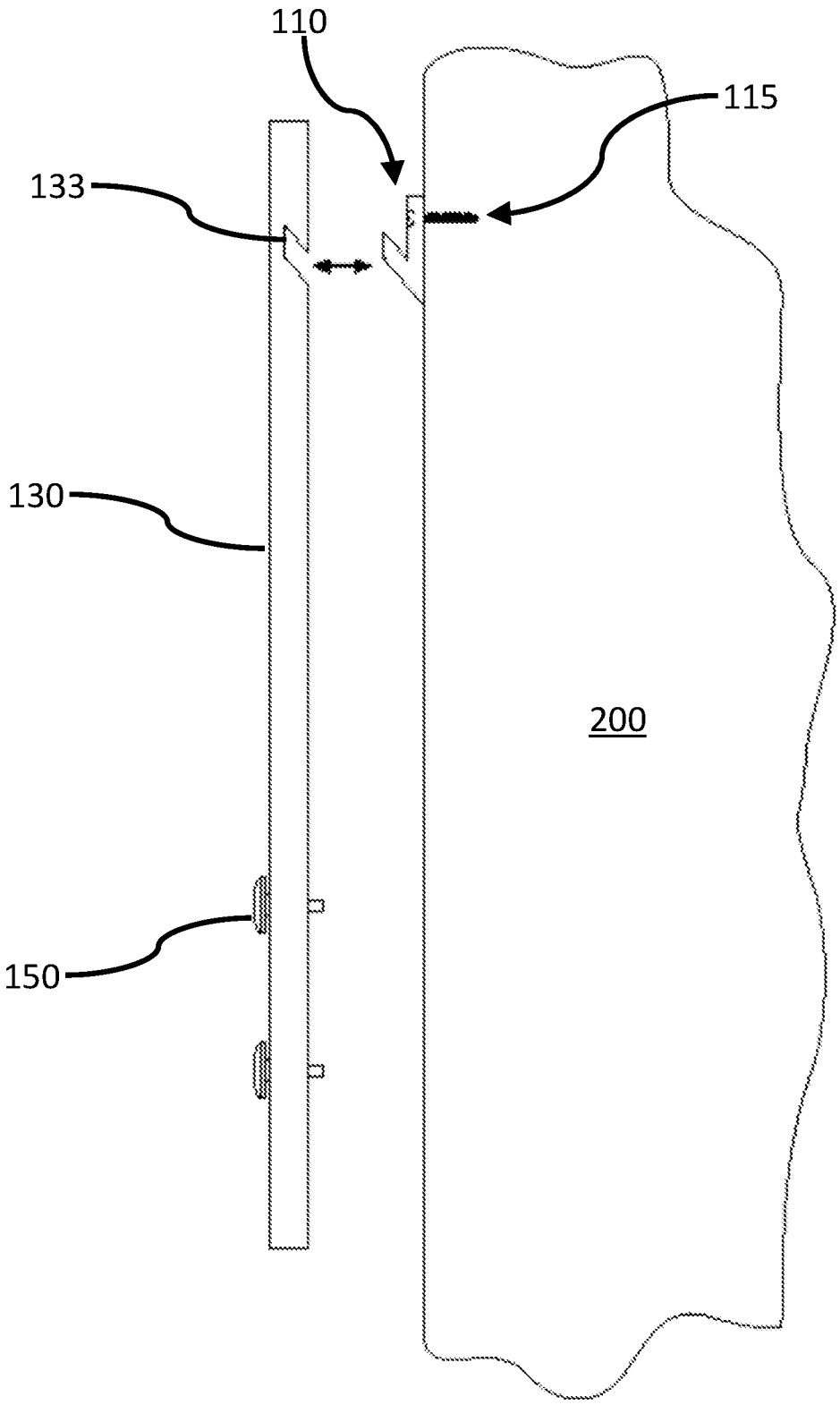
FIG. 2 illustrates a side view of an example display mount system.

Referring now to the drawings, particularly by their reference numbers, FIGS. 1 & 2 illustrate an example display mount system 100. System 100 may be suitable, for example, to mount a display to a vertical surface. Display mounting system 100 includes an angle bar 110, a first rail 120, a second rail 130, a carriage 140 and a number of anchors 150.

Angle bar 110 has a first planar portion or leg 111 with a number of fastener holes 112 and a second planar portion or leg 116 extending from first leg 111 at an angle. In an example, an acute angle is defined between first leg 111 and second leg 116 of angle bar 110. First leg 111 is configured for mounting to a support surface such as a wall and fastener holes 112 facilitate mounting or otherwise attaching angle bar 110 to the support surface with a number of fasteners. While six fastener holes 112 are shown by way of example in FIG. 1, any number of fastener holes suitable for securely fixing angle bar 110 to the support surface may be provided. In an example, screws and/or bolts are suitable fasteners for engaging fastener holes 112.

Configured for hanging from angle bar 110, first and second rails 120 and 130 may be considered hanging rails. First and second rails 120 and 130 each have a length between first and second ends and a transverse slot 133 (FIG. 2) for slidably engaging second leg 116 of angle bar 110. In an example, transverse slots 133 are provided near the first ends of first and second rails 120 and 130. Transverse slots 133 of first and second rails 120 and 130 may be formed at an angle matching the angle defined between first and second legs 111 and 116 of angle bar 110.

Further, transverse slots 133 may slidably engage second leg 116 of angle bar 110 such that the lengths of first and second rails 120 and 130 extend away from angle bar 110 and, when viewed from the front, are approximately perpendicular thereto with the second ends remote from angle bar 110. In their approximate perpendicularity with angle bar 110, first and second rails 120 and 130 may form and angle of about 88 to 92 degrees with angle bar 110 and/or will appear to be perpendicular to an ordinary observer. Alternatively or additionally, one or more hooks may be provided to first and second rails 120 and 130 to grip second leg 116 of angle bar 110. In an example, the hooks are provided near the first ends of first and second rails 120 and 130.

Each of first and second rails 120 and 130 may include a series of perforations 121 extending along their lengths. For example, perforations 121 may extend through front and rear faces of first and second rails 120 and 130.

Carriage 140, which is configured for selectively sliding along first and second rails 120 and 130 towards the first or second ends, includes a display mounting panel or platform 141.

Mounting platform 141 may extend towards and away from angle bar 110 and generally between first and second rails 120 and 130. Mounting platform 141 may take any of a variety of shapes suitable for mounting a display, including but not limited to a rectangle having a small thickness relative to its length and width.

Carriage 140 may be configured for sliding along first and second rails 120 and 130 such that the display mounting panel extends at least partially between first and second rails 120 and 130 and the first and second ends thereof. Front and/or back surfaces of mounting platform 141 may extend in a plane approximately parallel with first leg 111 of angle bar 110 and/or approximately parallel with first and second rails 120 and 130. In their approximate parallelism with first leg 111 of angle bar 110 and/or the first and second rails 120 and 130, the front and/or back surfaces of mounting platform 141 may form small angles with first leg 111 and/or first and second rails 120 and 130, for example, about 1-3 degrees and will otherwise appear to be parallel to an ordinary observer. In an example, mounting platform 141 forms an oblique angle with second leg 116 of angle bar 110.

There may be a number of display mounting holes 149 provided to mounting platform 141 each configured to receive a fastener. While four mounting holes 149 are shown by way of example in FIG. 1, any number of mounting holes suitable for securely fixing an object such as a display to mounting platform 141 may be provided. In an example, screws and/or bolts are suitable fasteners for engaging mounting holes 149.

A first portion of carriage 140 may be configured to at least partially surround a circumference of first rail 120 while a second portion of carriage 140 may be configured to at least partially surround a circumference of second rail 130. In an example, a first arm 142 extends from mounting platform 141 in a first direction to a first distal end and a second arm 144 extends from mounting platform 141 in a second, opposite direction to a second distal end. When engaged with first and/or second rails 120 and 130, the first distal end may at least partially surround a circumference of first rail 120 while the second distal end may at least partially surround a circumference of second hanging rail 130. For example, a front surface of each of first and second arms 142 and 144 may overlap a front surface of each of first and second rails 120 and 130. Further, a rear surface of each of first and second arms 142 and 144 may overlap a rear surface of each of first and second rails 120 and 130. First and second arms 142 and 144 may each have a length along which they are aligned and may be of a single continuous piece.

Display mount system 100 may further include a third arm 146 extending from mounting platform 141 in the first direction to a third distal end and a fourth arm 148 extending from mounting platform 141 in the second direction to a fourth distal end. As with the first and second distal ends, when engaged with first and/or second rails 120 and 130, the third distal end may at least partially surround a circumference of first rail 120 while the fourth distal end may at least partially surround a circumference of second rail 130. For example, a front surface of each of third and fourth arms 146 and 148 may overlap a front surface of each of first and second rails 120 and 130. Further, a rear surface of each of third and fourth arms 146 and 148 may overlap a rear surface of each of first and second rails 120 and 130. The third and fourth arms 146 and 148 may each have a length along which they are aligned.

Anchors 150 are configured for selectively locking carriage 140 to rails 120 and 130 at any of a variety of positions between the first and second ends of rails 120 and 130. For example, anchors 150 may removably couple arms 142, 144, 146 and 148 to rails 120 and 130 at any selected position along the length of rails 120 and 130.

In an example, anchors 150 include pins configured for insertion through perforations (not visible) provided to carriage 140 and into any of a series of perforations 121 and 131 extending along the lengths of first and second rails 120 and 130. In a further example, the pins are configured to be inserted through a fastener hole in each of the first, second, third and fourth distal ends of arms 142, 144, 146 and 148 and through any of a series of perforations 121 provided along the lengths of first and second rails 120 and 130. As such, anchors 150 may engage a subset of the series of perforations 121 of each of rails 120 and 130.

Figure 3:
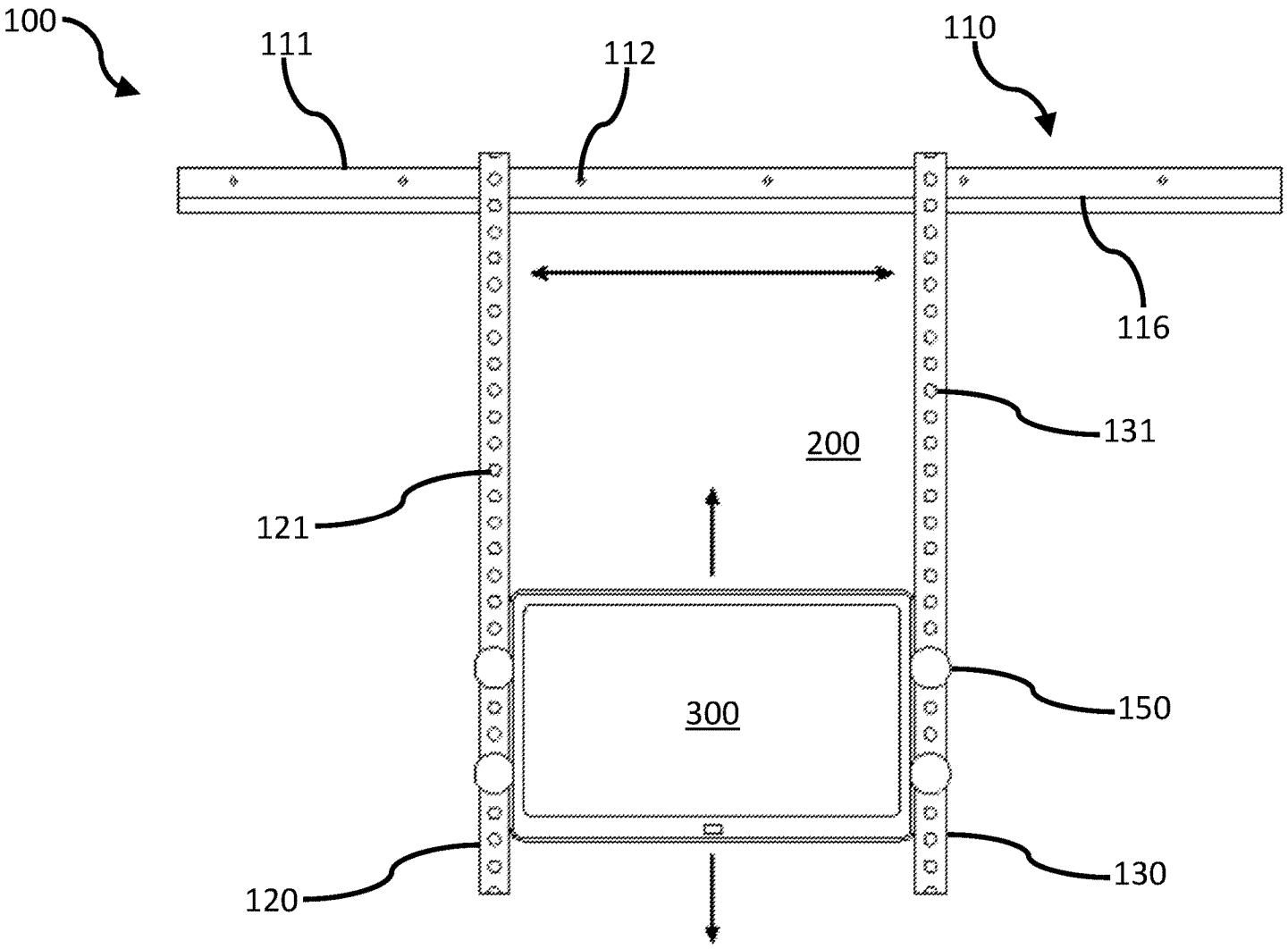
FIG. 3 illustrates a front view of an example display mount system with a display coupled therewith.

While four anchors 150 are illustrated by way of example in FIGS. 1 & 3, any number of anchors suitable for temporarily securely fixing carriage 140 and/or carriage arms 142, 144, 146 and 148 to first and second rails 120 and 130 may be provided. Similarly, while approximately 28 perforations 121 are illustrated by way of example in FIGS. 1, any number of perforations suitable for receiving the pins to temporarily securely fix carriage 140 and/or carriage arms 142, 144, 146 and 148 to first and second rails 120 and 130 may be provided.

Components of system 100 may be manufactured from any of a variety of rigid, durable materials having surfaces with relatively low coefficients of kinetic friction including but not limited to metals such as aluminum, titanium and steel and/or plastics such as high-density polyethylene.

Disclosed systems are suitable for use in association with one or more methods for mounting a display to a support surface which may be a vertical surface such as a wall. The method includes providing an angle bar having a first planar portion or leg and a second planar portion or leg extending from the first leg and mounting the first leg to the support surface with one or more fasteners. In an example, the angle bar is mounted to the support surface in a generally horizontal orientation. First and second rails each having a length between first and second ends are hung from the second leg of the angle bar such that they are slideable along the second leg. To the first and second rails, a carriage having a display mounting panel is locked at any of a variety of positions between the first and second ends with, for example, one or more anchors.

The carriage may be locked to the first and second rails with the anchors by engaging a subset of a series of perforations provided along the length of each of the rails. In an example, the perforations are engaged by the anchors by inserting pins through perforations provided to the carriage and into any of the perforations provided along the lengths of the first and second rails. In a further example, the pins are clevis pins.

The carriage may be locked to the first and second rails by at least partially surrounding a circumference of the first rail with a first portion of the carriage and at least partially surrounding a circumference of the second rail with a second portion of the carriage. For example, extensions of arms of the carriage may overlap front and/or rear surfaces of the first and second rails.

Figure 4:
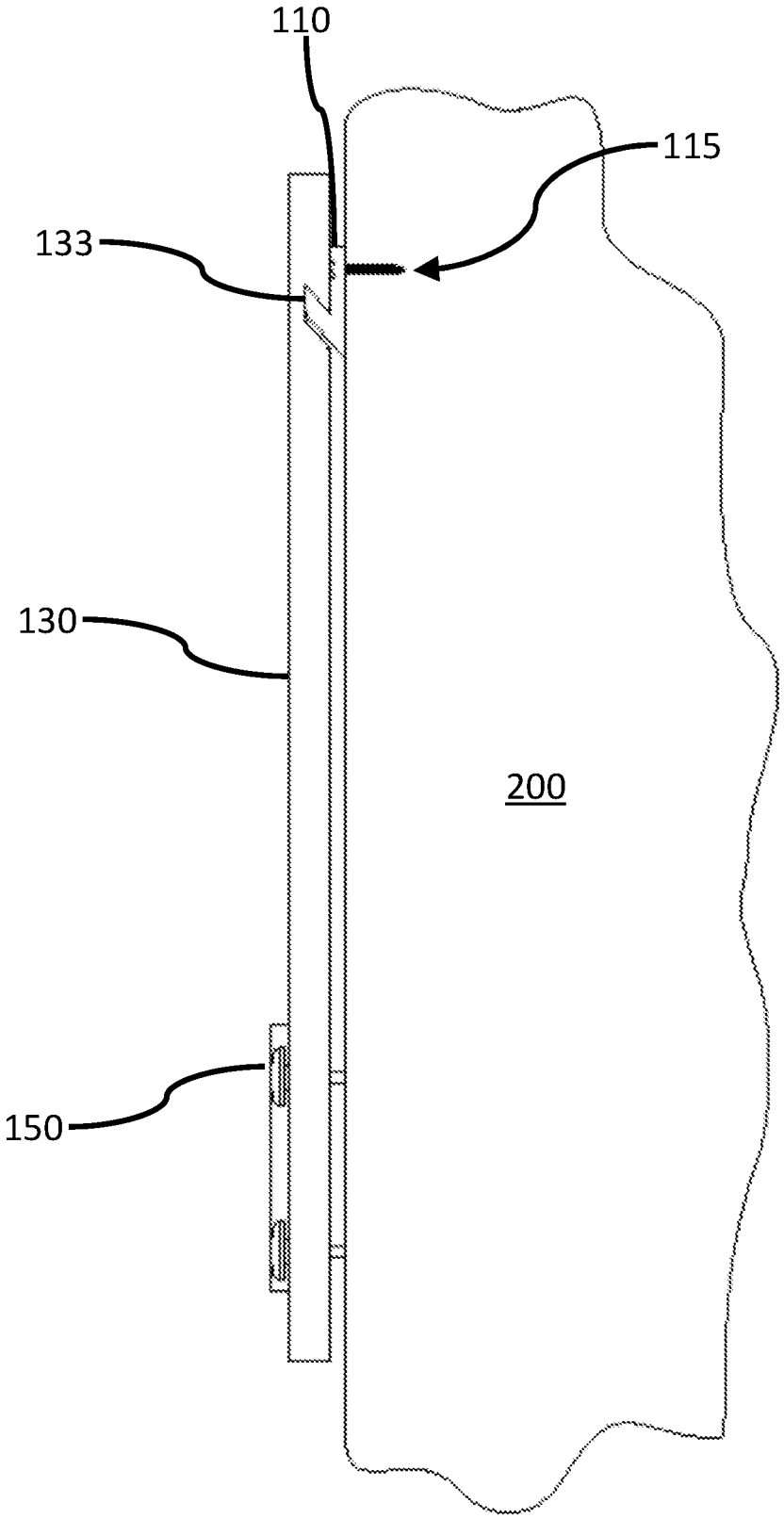
FIG. 4 illustrates a side view of an example display mount system with a display coupled therewith.

In an example, a display is coupled with the mounting panel of the carriage with a number of fasteners. FIGS. 3 & 4 illustrate an example display mount system having a display coupled therewith.

Additionally or alternatively, the carriage may be locked to the first and second rails and a display coupled with the carriage prior to the first and second rails being hung from the second let of the angle bar.

When it is desirable to change the horizontal position of a display coupled with the carriage and/or mounting panel, the first and second rails may be slid along the length of the angle bar in the desired direction. When it is desirable to change to vertical position of a display coupled with the carriage, the anchors locking the carriage to the first and second rails may be removed while the carriage is repositioned along the length of the first and second rails. With the carriage and display repositioned, the anchors may be replaced at the new position along the length of the first and second rails to lock the carriage, and thereby the display, in position along the first and second rails.

The actions described above are only illustrative and other alternatives can also be provided where one or more actions are added, one or more actions are removed, or one or more actions are provided in a different sequence without departing from the scope of the claims herein.

Embodiments of the disclosure are susceptible to being used for various purposes, including, though not limited to, enabling users to adjustable mount objects to support surfaces with reduced damage to the support surfaces.

Modifications to embodiments of the disclosure described in the foregoing are possible without departing from the scope of the disclosure as defined by the accompanying claims. Expressions such as "including", "comprising", "incorporating", "consisting of", "have", "is" used to describe and claim disclosed features are intended to be construed in a non-exclusive manner, namely allowing for items, components or elements not explicitly described also to be present. Reference to the singular is also to be construed to relate to the plural.

What is claimed is:

1. A display mount system, comprising:

an angle bar having a first leg with a plurality of fastener holes and a second leg;

first and second hanging rails each having a length and a transverse slot slidably engaging the second leg of the angle bar such that the length of the first and second hanging rails is approximately perpendicular to the angle bar;

a carriage including a display mounting platform, a first arm extending from the mounting platform in a first direction to a first distal end and a second arm extending from the mounting platform in a second, opposite direction to a second distal end; and a plurality of anchors removably coupling the first and second arms to the first and second hanging rails transverse thereto.

2. The display mount system as set forth in claim 1, wherein an acute angle is defined between the first leg and the second leg of the angle bar.

3. The display mount system as set forth in claim 2, wherein the transverse slots of the first and second hanging rails are formed at an angle matching the angle defined between the first and second legs of the angle bar.

4. The display mount system as set forth in claim 1, wherein each of the first and second hanging rails includes a front face and a rear face and a plurality of perforations extending through the front and rear faces.

5. The display mount system as set forth in claim 1, wherein the hanging rails include a series of perforations extending along their lengths.

6. The display mount system as set forth in claim 5, wherein the anchors engage a subset of the series of perforations of each of the hanging rails.

7. The display mount system as set forth in claim 1, wherein the mounting platform extends towards and away from the angle bar.

8. The display mount system as set forth in claim 1, wherein the mounting platform is approximately parallel with the first and second rails.

9. The display mount system as set forth in claim 1, wherein the anchors removably couple the arms to the hanging rails at any of a plurality of positions along the length of the hanging rails.

10. The display mount system as set forth in claim 1, wherein the first distal end at least partially surrounds a circumference of the first hanging rail while the second distal end partially surrounds a circumference of the second hanging rail.

11. The display mount system as set forth in claim 1, further comprising a third arm extending from the mounting platform in the first direction to a third distal end and a fourth arm extending from the mounting platform in the second direction to a fourth distal end.

12. The display mount system as set forth in claim 11, wherein the third distal end at least partially surrounds a circumference of the first hanging rail while the fourth distal end partially surrounds a circumference of the second hanging rail.

13. The display mount system as set forth in claim 12, wherein the anchors include pins configured to be inserted through a fastener hole in each of the first, second, third and fourth distal ends and through any of a series of perforations provided along the lengths of the first and second hanging rails.

14. A system for mounting a display to a vertical surface, comprising:

an angle bar having a first planar portion configured for mounting to the vertical surface and a second planar portion extending from the first planar portion;

configured to hang from the second planar portion of the angle bar and slide therealong, at least one rail having a length defined between first and second ends;

configured for selectively sliding along the rail towards the first or second ends, a carriage including a display mounting panel; and configured for selectively locking the carriage to the rail at any of a variety of positions between the first and second ends, a plurality of anchors.

15. The system as set forth in claim 14, wherein the anchors are configured to engage a subset of a series of perforations provided along the length of the rail.

16. The system as set forth in claim 14, wherein the anchors include pins configured for insertion through perforations provided to the carriage and into any of a series of perforations extending along the length of the rail.

17. The system as set forth in claim 14, wherein the anchors are configured for selectively coupling the carriage at any of a plurality of positions along the length of the rail.

18. The system as set forth in claim 14, wherein the at least one rail comprises first and second rails configured to hang from the second planar portion of the angle bar and slide therealong.

19. The system as set forth in claim 18, wherein a first portion of the carriage is configured to at least partially surround a circumference of the first rail while a second portion of the carriage is configured to at least partially surround a circumference of the second rail.

20. The system as set forth in claim 18, wherein the carriage is configured for sliding along the first and second rails such that the display mounting panel extends at least partially between the first and second rails and the first and second ends thereof.

21. The system as set forth in claim 18, wherein the carriage is configured for sliding along the first and second rails such that the display mounting panel is approximately parallel with the first planar portion of the angle bar.

* * * * *